US008832959B2

(12) United States Patent
Hasch et al.

(10) Patent No.: US 8,832,959 B2
(45) Date of Patent: Sep. 16, 2014

(54) WOOD CHIP DRYING SYSTEM FOR DRYING WOOD CHIP AND ASSOCIATED METHOD FOR DRYING WOOD CHIP

(75) Inventors: Joachim Hasch, Berlin (DE); Matthias Iredi, Bad Muender (DE)

(73) Assignee: Kronotec AG, Lucerne (CH)

( * ) Notice: Subject to any disclaimer, the term of this patent is extended or adjusted under 35 U.S.C. 154(b) by 220 days.

(21) Appl. No.: 13/202,301

(22) PCT Filed: Mar. 1, 2010

(86) PCT No.: PCT/EP2010/001245

§ 371 (c)(1), (2), (4) Date: Aug. 18, 2011

(87) PCT Pub. No.: WO2010/102736

PCT Pub. Date: Sep. 16, 2010

(65) Prior Publication Data

US 2011/0305897 A1 Dec. 15, 2011

(30) Foreign Application Priority Data

Mar. 10, 2009 (EP) ..... 090034406

(51) Int. Cl.
*F26B 21/06* (2006.01)
*F26B 3/00* (2006.01)
*F26B 23/02* (2006.01)

(52) U.S. Cl.
CPC ..... *F26B 23/022* (2013.01); *F26B 2210/16* (2013.01); *F26B 23/024* (2013.01)
USPC ..... 34/77; 34/72; 34/477

(58) Field of Classification Search
USPC ..... 34/77, 79, 219, 86, 477, 90, 427, 72, 34/471; 110/224, 204; 428/326; 156/62.2
See application file for complete search history.

(56) References Cited

U.S. PATENT DOCUMENTS 3,721,014 A * 3/1973 Voelskow ..... 34/371
3,818,975 A * 6/1974 Tokumitsu et al. ..... 165/95

(Continued)

FOREIGN PATENT DOCUMENTS

DE 1912480 3/1965
DE 3517433 11/1986

(Continued)

*Primary Examiner* — Kenneth Rinehart
*Assistant Examiner* — John McCormack
(74) *Attorney, Agent, or Firm* — Andrew M. Calderon; Roberts Mlotkowski Safran & Cole, P.C.

(57) ABSTRACT

A wood chip drying system for drying wood chip includes a furnace, a drier for the wood chip and a recirculation apparatus for the recirculation of exhaust vapors into their drier. The recirculation apparatus has an exhaust vapor heater, and the wood chip drying system is designated to reduce organic compounds present in the exhaust vapor prior to the recirculation into the drier. The exhaust vapor heater includes a regenerative and/or catalytic heat exchanger which is arranged downstream after the drier and which is designated so as to heat up the exhaust vapor to a temperature which is high enough to oxidize at least a majority of particles present in the exhaust vapor.

16 Claims, 3 Drawing Sheets

(56) References Cited

U.S. PATENT DOCUMENTS

| | | | | |
|---|---|---|---|---|
| 3,949,548 | A * | 4/1976 | Lockwood, Jr. | 60/39.15 |
| 4,339,883 | A | 7/1982 | Waldmann | |
| 4,384,850 | A | 5/1983 | Dixon | |
| 4,411,204 | A * | 10/1983 | Hamilton | 110/347 |
| 5,237,757 | A | 8/1993 | Wiedmann | |
| 5,263,266 | A * | 11/1993 | Schmidt | 34/478 |
| 5,697,167 | A | 12/1997 | Kunz | |
| 5,983,521 | A | 11/1999 | Thompson | |
| 6,357,144 | B1 * | 3/2002 | Nilsson et al. | 34/467 |
| 6,393,727 | B1 | 5/2002 | Seelig | |

FOREIGN PATENT DOCUMENTS

| | | | |
|---|---|---|---|
| DE | 4036666 | | 5/1991 |
| DE | 19654043 | | 7/1997 |
| DE | 19728545 | | 1/1999 |
| DE | 10011177 | | 9/2001 |
| DE | 10011177 | A1 * | 9/2001 |
| DE | 10157596 | | 3/2003 |
| EP | 0459603 | | 12/1991 |
| EP | 0714006 | | 5/1996 |
| WO | WO 01/59381 | | 1/1981 |
| WO | WO 99/09364 | | 2/1999 |
| WO | WO 0159381 | A1 * | 8/2001 |

* cited by examiner

WOOD CHIP DRYING SYSTEM FOR DRYING WOOD CHIP AND ASSOCIATED METHOD FOR DRYING WOOD CHIP

FIELD OF THE INVENTION

The invention relates to a wood chip drying system for drying wood chip, with a furnace, with a drier for the wood chip and with a recirculation device for recirculating vapors into the drier, the recirculation device having a vapor heater, and the wood chip drying system being designed for the reduction of organic compounds present in the vapor prior to recirculation into the drier.

According to a second aspect, the invention relates to a method for drying wood chip, with the steps (a) conduction of flue gas from a furnace to a drier, (b) drying of the wood chip in the drier, so that vapour is obtained, and (c) recirculation of at least part of the vapor into the drier.

DISCUSSION OF BACKGROUND INFORMATION

In known wood chip drying systems, wood dust is usually burnt in the furnace. The hot flue gases occurring are routed into a mixing chamber and are to be mixed there with vapor which is also called back vapor. Owing to mixing, the temperature of the drier gas occurring falls to approximately 380° C. to 420° C. The drier gas is subsequently supplied to the drier where the wood chip is dried.

The vapor occurring is delivered to a cyclone and then partially recirculated into the mixing chamber. The dried wood chip is then blended with glue and pressed into a wood material board. The disadvantage of wood chip drying systems of this type is that the wood material boards produced from the wood chip may give off volatile organic substances.

Also known hot-gas generation and drying of the wood chip take place in that primarily wood dust with a dedicated combustion air supply is burnt in a combustion chamber. The approximately 900-degree flue gases from this combustion enter a mixing chamber in which the back vapor, as it is known, the secondary air for cooling and, if appropriate, external hot gas are introduced. In the mixing chamber, the drying hot gases to be introduced into the chip drier are set at the necessary requirements (temperature of approximately 350-480° C., overall volume flow and moisture content). The hot gas volume flow or drying air volume flow thus prepared is sucked via the drier drum by means of a suction draft fan. In the drier drum, the wood chip is dried in direct contact with the hot gases. The suction draft fan conveys the overall hot gas volume flow involved in the drying process to a filter system which is designed predominantly as a cyclone separator, but also as an electrostatic wet filter. This filter system primarily separates only solid particles to a limited extent. Upsteam or downsteam of this filter system, a substream, called the back vapor volume flow, is delivered to the abovementioned mixing chamber again.

The drying of the wood chip requires a balanced temperature, energy and volume flow equilibrium which must be set as a function of the product (chip size, throughput, moisture content, type of drier).

The dried wood chip is separated downstream of the drier drum, blended with glue and pressed into a wood material board. The disadvantage of wood chip drying systems of this type is that the wood material boards produced from the wood chip may give off volatile organic substances arising from resins and terpenes.

The hot gases for drying the wood chip partially absorb the resins and terpenes contained in them from the wood. The best effect for this purpose is achieved in that the drier hot gases are free of ballast substances of the same type at the entrance of the drier. However, the hot gases at the drier entrance are mixed according to known methods with back vapors which have already participated in the drying process. The absorption of resins and terpenes by the mixing volume flow is therefore reduced.

It is also known to route the vapors completely in a closed circuit, that is to say the drier hot gases conducted into the drier are generated entirely from vapors, mixed with the exhaust gases from the combustion of primary fuels. To improve the method in energy terms, the vapors are partially conducted into the combustion chamber and treated thermally here at approximately 850° C. The other vapor fraction is conducted via a tube bundle heat exchanger and is heated here to approximately 380 to 450° C., while at the same time the (50 degree) hot gases from the combustion chamber are cooled. The vapors heated via the heat exchanger are not treated thermally on account of the temperature level. Major disadvantages of this type of hot gas generation by means of the tube bundle heat exchanger systems are low availability on account of contamination of the heat exchanger surfaces. Only part of the vapors pass through thermal treatment. The combustion air for burning the primary fuel is sucked in externally. The thermal efficiency of the method is relatively unfavorable.

It is therefore also known to route the vapors entirely in a closed circuit, that is to say the drier gas conducted in the drier was generated entirely from vapor in which volatile compounds were oxidized thermally. The disadvantage of this is that a wood chip drying system of this type has low availability.

U.S. Pat. No. 5,983,521 discloses a wood chip drying system in which the back vapors are recirculated completely into the combustion chamber. To save energy, the back vapors are conducted through a recuperator which is fed with hot gas from the furnace. All the back vapors are thereby treated thermally in the combustion chamber. The disadvantage of this is that the efficiency of the furnace falls, since all the back vapors have to be routed completely through the furnace.

A garbage drying system is known from DE 197 28 545 A1. Contrary to wood drying systems, the moisture content and the terpene and fine dust content do not play a relevant part in garbage drying systems, and therefore the apparatus described there is not suitable for drying wood chip. CH 133 536 discloses a method for drying bulk goods which is of the multistage type. The publication does not describe a regeneratively or catalytically active heat exchanger.

DE 29 26 663 discloses a method in which the vapors are cooled in order to achieve condensation of the water and of the entrained terpenes. The disadvantage of this is the high outlay for cooling down the vapors.

WO 01/59381 discloses a wood chip drying system in which part of the vapors is recirculated into the combustion chamber. The disadvantage here is that part of the terpenes contained in the back vapors may settle on the product to be dried, so that the wood chip, after leaving the drier, has an increased content of volatile organic constituents.

SUMMARY OF THE INVENTION

The subject on which the invention is based is to specify a wood chip drying system in which the furnace can be operated with especially high efficiency and in which the wood chip has an especially low content of volatile organic constituents.

The invention solves the problem by means of a generic wood chip drying system in which the vapor heater comprises a regenerative and/or regenerative/catalytic heat exchanger which is arranged downstream of the drier and which is designed for heating the vapors to a temperature which is so high that particles present in the vapor are at least for the predominant part oxidized.

According to a second aspect, the invention solves the problem by means of a generic method which comprises the step of thermal reduction of solids present in the vapor prior to recirculation into the drier in a regenerative and/or catalytic heat exchanger.

Moreover, according to the invention, a wood material board is produced by a method according to the invention.

The advantage of the invention is that, by solids present in the vapor being oxidized by the regenerative heat exchanger, these solids cannot become enriched in the drier gas. In fact it has been shown that such solids, for example small wood chips, can easily settle in lines or recuperative heat exchangers and lead to operating faults.

A further advantage is that this advantage can be achieved by means of relatively minor changes in existing wood chip drying systems. The aspect of an economical operating mode, along with the least possible use of primary fuel, is also the basis of the invention. The invention will appreciably reduce the pollutants which adhere or are contained during the drying of the chip or during the subsequent production of chipboards and/or OSB boards. Also, the emissions caused by the residual pollutants in the exhaust gases to be discharged into the atmosphere are drastically reduced.

The advantage of the invention is that, as a result of the oxidation of hydrocarbons present in the vapors and of the combustible solids by the thermally regenerative heat exchanger system, the absorption capacity of the hot gases introduced into the drier with regard to emerging resins and terpenes is increased and therefore the remaining load upon the dried wood chip is drastically reduced. The assemblies and pipelines carrying hot gas between the thermally regenerative system and the drier entrance are likewise drastically reduced in terms of their tendency to contamination. The availability of the system is consequently appreciably increased.

The invention described also has, in particular, the advantage that existing hot gas generation systems can be retrofitted at low outlay, with existing system components being preserved.

Within the scope of the present description, a furnace is understood particularly to mean a wood product furnace which burns wood chip (biomass) or wood dust. Such a furnace may also have backup control, for example gas and/or oil backup control.

The drier is understood, in particular, to mean any apparatus which is setup and designed for drying wood chip. In particular, the drier is provided with an associated control which set a hot gas drying temperature and hot gas volume flow at the drier entrance such that a technologically necessary residual moisture content in the wood chip is achieved at the drier exit.

The recirculation apparatus is understood, in particular, to mean any apparatus which is designed for recirculating gases (vapors) leaving the drier to a location in the wood chip drying system such that these gases (vapors) flow through the drier once again.

The vapor is understood to mean that gas which leaves the drier. It is possible that only part of the vapors (called "back vapors") is treated such that organic compounds present in the back vapors are oxidized or combustible solid particles are burnt. In this case, part of the vapor is not recirculated, but is instead discharged into the atmosphere via a vapor purification system. It is also possible, however, that the entire vapors are supplied completely, downstream of the drier, to an apparatus for the oxidation of organic compounds present in the vapors and for the combustion of combustible solid particles, so that the emission into the atmosphere which still remains the fall substantially.

The feature that the wood chip drying system is designed for the removal of solids present in the vapor prior to recirculation into the drier is understood, in particular, to mean that at least part of the vapors is treated such that a concentration of solids falls markedly. In particular, the wood chip drying system is designed such that at least that part of the vapor which enters the drier once again is treated such that the concentration of solids is lowered by at least 75% to 90%. The particles are understood, in particular, to means wood particles.

For example, the wood chip drying system is designed for heating at least part of the vapors to a temperature of at least 720° C. As a rule, it is sufficient to select a temperature of at most 900°. The temperature is selected such that a predominant part of the solids is oxidized.

The hot gas generation system, together with its devices, is designed such that essentially all organic substances (CnHm compounds) and also combustible solid particles are removed by thermal treatment from the drying hot gases prior to introduction to the drier.

The invention is also based on the aspect that the back vapors are heated completely to a temperature of 720 to 900° C. and therefore all organic combustible substances are burnt or oxidized virtually completely. This applies particularly to all hydrocarbon compounds (CnHm compounds), but also to all combustible wood-like solid particles which are introduced via the back vapors. Furthermore, after regenerative treatment, the thermally treated back vapors are supplied as combustion air at appropriate temperature to the combustion chamber for wood burning or natural gas, light oil or heavy oil burning, thus entailing a fuel saving.

In particular, the recirculation device is designed for recirculating at least part of the thermally regeneratively treated vapors into the furnace. In other words, according to the invention, a generic wood chip drying system is designed such that all the back vapors, that is to say vapors which enter the drier once again, are returned to the furnace. There, the vapors are supplied as combustion air to the flame, for example the wood dust flame, natural gas flame, light oil flame and/or heavy oil flame, so that a fuel saving is ensured. Alternatively, however, thermally untreated vapors may also be supplied for combustion, in which case the thermal treatment of the hydrocarbons and combustible solid particles takes place only in the flame. In this variant, however, operating faults are preprogrammed owing to dirt on the burner and its secondary assemblies, along with reduced availability.

For example, the recirculation device is designed for heating the vapors to a temperature of at least 750°. In general, a temperature window of 7200° C. to 900° C. is suitable. It is possible that the vapor heater also possesses a catalytic exhaust air treatment system in which organic substances are oxidized catalytically. In this case, only temperatures of 380 to 480° C. will be necessary. However, the combustible solid particles remain unburnt in the catalytic method.

The vapor heater is preferably designed such that the vapors, together with the organic compounds and, if appropriate, remaining solid particles, participate completely in combustion. The thermally regenerative purification system may be designed such that the treated vapors leave the exhaust air treatment system at a temperature which is between 20° C. and 80° C. higher.

A thermally regenerative exhaust air treatment system is especially suitable when the treated vapors leave it at an approximately 40° C. higher temperature.

The recirculation device is preferably designed for heating the vapor by means of flue gas from the wood dust furnace. Alternatively or additionally, the purification system is also designed such that primary fuels, such as natural gas, light oil and/or heavy oil, may also be used for reheating the vapors.

A mixing chamber may be arranged downstream of the furnace and/or downstream of the thermal exhaust air treatment system, and in this mixing chamber the flue gas from the furnace is mixed with the treated vapors from the exhaust air treatment system and, if appropriate, with secondary air and secondary hot gases such that the drier hot gas occurring has a predetermined temperature and predetermined moisture content. The drier hot gas is then supplied to the drier.

According to a preferred embodiment, the wood chip drying system has a nitrogen oxide reduction system arranged downstream of the furnace. This nitrogen oxide reduction system operates especially effectively in a temperature window of 800 to 950° C. Urea can be injected into the flue gas stream in the nitrogen oxide reduction system, so that the nitrogen oxides contained in the flue gas are reduced.

The nitrogen oxide reduction system is preferably arranged such that the injection point at which the urea is injected is arranged in a connection between the furnace and the mixing chamber. The nitrogen oxide reduction system can reduce the nitrogen oxide emissions by more than 30%, 50% being achievable.

According to a preferred embodiment, the wood chip drying system comprises a drier gas moistening device for increasing the moisture content of drier gas flowing into the drier. The drier gas moistening device 18' is preferably operated such that an absolute atmospheric moisture comprises at least 600 grams per cubic meter. It has proved beneficial if the absolute atmospheric moisture lies below 1200 grams per cubic meter.

It is beneficial if the drier gas moistening device is set up for mixing vapor and flue gas from the furnace such that the moisture content of the drier gas is set at a desired value.

It is advantageous here that the increased moisture content dissolves water-soluble substances out of the wood chip. To that extent, the drier is designed at the same time as a hot extraction device in which water-soluble substances are dissolved out of the wood chip. Enrichment of the substances dissolved out of the wood chip in this way is prevented by the above-described internal post combustion in the recirculation device for the recirculated vapors.

The wood chip drying system is preferably designed such that at least 70% of the terpenes present in the wood chip is dissolved out during drying. This decrease of terpenes in the chip ensures a drastic lowering of the terpene emissions in wood material boards manufactured from the chip.

Alternatively, the hot gas generation system may also contain a regenerative heat exchanger system which is arranged between the combustion chamber and the mixing chamber. The preheated vapors are then supplied to the combustion chamber and essentially freed there thermally of the hydrocarbons and combustible solid particles contained in them. The regenerative heat exchanger system may be designed such that a thermal efficiency of up to 95% is achieved here. The regenerative heat exchanger system is likewise equipped with a purification method (burn out), this allowing purification during continuous operation and ensuring very high availability.

A method according to the invention is distinguished in that at least part of the vapors is recirculated into the furnace. Alternatively or additionally, there is provision whereby part, in particular a predominant part, of those vapors which are recirculated is retreated thermally, so that a concentration of organic compounds undershoots a predetermined threshold value.

Wood chip predominantly comprising pine chip is used especially preferably. Pine chip has a high content of terpenes, such that in the case of previous drying methods for drying this chip a high fraction of terpenes has remained in the chip. This lowers the quality of the wood material boards produced from this wood chip. The invention makes it possible here to have an especially pronounced increase in the quality of the wood material boards.

A method is preferred in which in the back vapor volume flow, before entry into the mixing chamber, passes through a thermally regenerative heat exchanger system. In the heat exchanger system, the back vapors having an entry temperature of 80 to 130° C. are heated to a temperature of 720° C. to 900° C. and are routed to the mixing chamber by means of a fan at an exit temperature approximately 20 to 80° C. higher than the entry temperature. Heating takes place in the regenerative heat exchanger systems with a thermal efficiency of 88 to 97%, depending on the version used. Primary heating for finally heating up the back vapors to 720 to 900° C. takes place with the introduction of hot gases from the wood dust furnace or, alternatively, with natural gas, light oil or heavy oil.

According to the invention, moreover, there is a method for producing a wood material board, in particular an OSB board, with the steps (a) production of wood chip by means of a method according to the invention, a predetermined residual moisture content in the wood chip being set, (b) mixing of the wood chip with adhesive and (c) pressing of the wood chip together with the adhesive to form the wood material board.

A method according to the invention preferably comprises the step of burning free the regenerative heat exchanger. It has been shown that solids may settle in the heat exchanger. This can be eliminated by free burning (burn out). It is beneficial if the vapor heater comprises at least two regenerative heat exchangers, so that burning free can take place during continuous operation.

According to the invention, moreover, there is a wood material board which has been produced by a method according to the invention. In particular, according to the invention, a wood material board comprises pine chip, of which the terpene content in percentage by weight is lower than 50% of the concentration contained in natural untreated pine chip.

BRIEF DESCRIPTION OF THE DRAWINGS

The invention is explained in more detail below by means of an exemplary embodiment. In the drawing.

DETAILED DESCRIPTION OF THE PRESENT INVENTION

Figure 1:
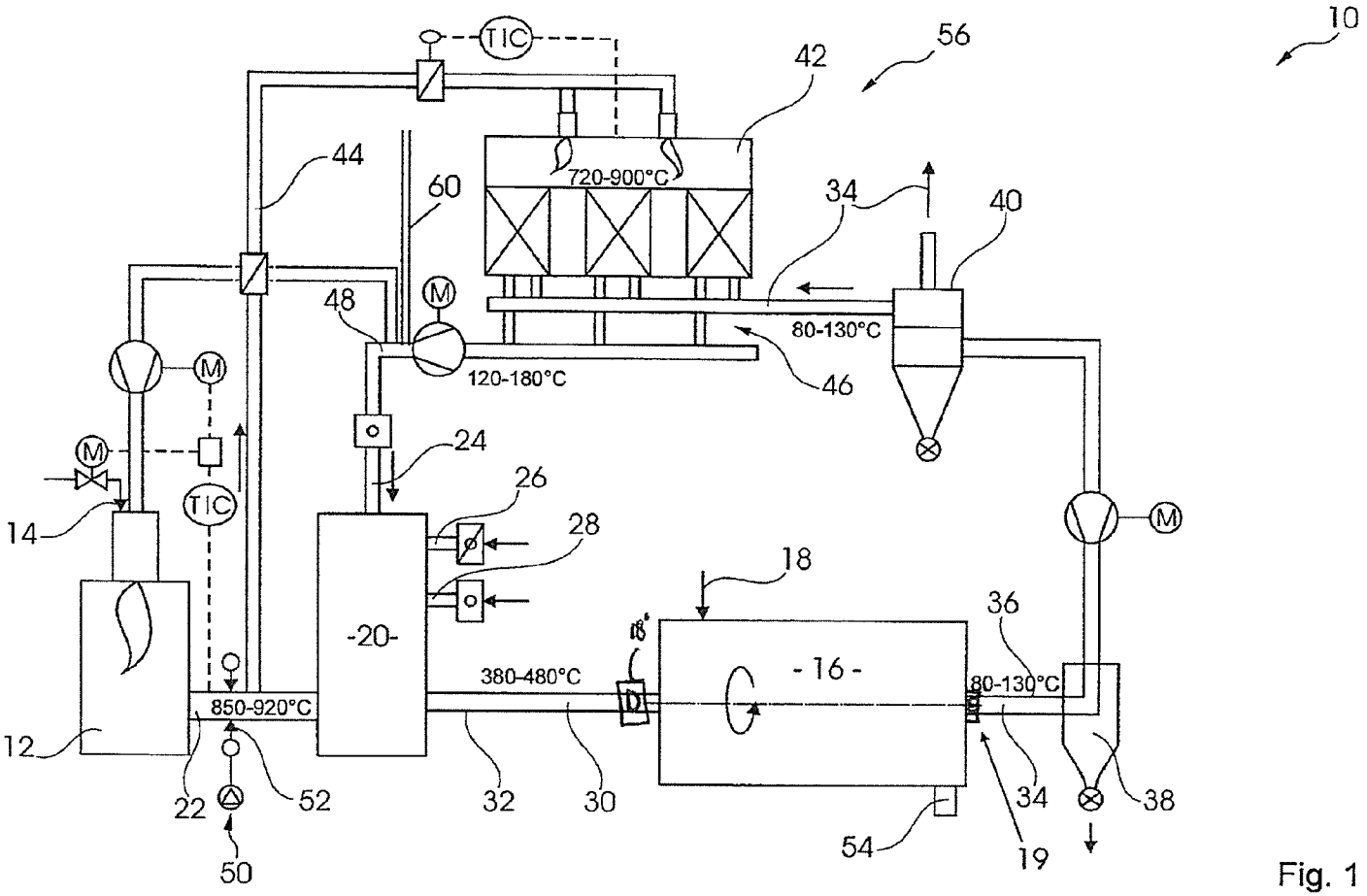
FIG. 1 shows a circuit diagram of a wood chip drying system according to the invention.

FIG. 1 shows a wood chip drying system 10 with a furnace 12 to which wood dust 14 depicted diagrammatically is supplied. The wood chip drying system 10 comprises, moreover, a drier 16 to which wood chip 18 is supplied in a wood chip feed. Dried wood chip leaves the drier 16 via a discharge 19.

The wood chip drying system has a mixing chamber 20 which is acted upon with flue gas 22 from the furnace 12. Moreover, a first vapor line 24, a cooling air line 26 and a hot gas line 28 issue into the mixing chamber 20. The mixing chamber 20 is designed to dispense drier gas 30 in a drier gas line 32, the drier gas 30 having a preset temperature and a preset absolute moisture content.

Vapor 34 leaves the drier 16 through a vapor discharge 36 which leads to a first cyclone 38 and then to a second cyclone 40. Part of the vapor is extracted from the vapor discharge 36 and conducted into an exhaust gas treatment system.

By means of the vapor discharge 36, the solid-depleted vapor 34 enters a vapor heater 42 which is operated via a flue gas line 44 with flue gas from the furnace 12. The vapor heater 42 is designed such that the vapor 34 is heated to a temperature T=900° C. However, other temperatures of between 420° C. and 850° C. are also possible. In this case, a large part of the organic compounds present in the vapor is oxidized, and purified vapor occurs which is delivered to the mixing chamber 20 through the first vapor line 24.

The vapor heater 42 comprises countercurrent coolers 46 which heat inflowing vapor 34 from the vapor discharge 36 and cool vapor flowing out into the first vapor line 24. The inflowing vapor has an inflow temperature of $T_{inflow}$=80° C., whereas an outflow temperature is approximately $T_{outflow}$=130°.

Vapor flowing out of the vapor heater 42 is divided at a branch point 48 into the stream to the mixing chamber 20 and a stream of back vapor to the furnace 12. Since the vapor 34 recirculated into the drier has been heated completely to a temperature above the oxidation temperature of the volatile organic compounds and the solids, A nitrogen oxide reduction system 50 comprising urea injection 52 is arranged directly downstream of the furnace 12. This urea injection 52 is arranged upstream of the flue gas line 44 and upstream of the mixing chamber 20 in the flow direction and leads to a selective reduction of the nitrogen oxides into nitrogen.

The components which are arranged downstream of the drier 16 with respect to the vapor stream are part of a recirculation device 56. The recirculation device 56 thus comprises in particular the vapor heater 42, which could also be designated as an oxidation reactor, and the lines 36, 44 and 24. Part of the vapors is conducted into the atmosphere via an exhaust air line 60.

The wood chip is preferably chips of fatty wood, for example coniferous wood and, particular, pine, which leave the drier 16 through an outlet 54, are then mixed with adhesive and are pressed into a wooden material board. This wood material board is preferably an OSB board. The wood material board exhibits drastically reduced terpene emission. The wood chip drying system according to the invention achieves a thermal efficiency of up to 97%.

Figure 2:
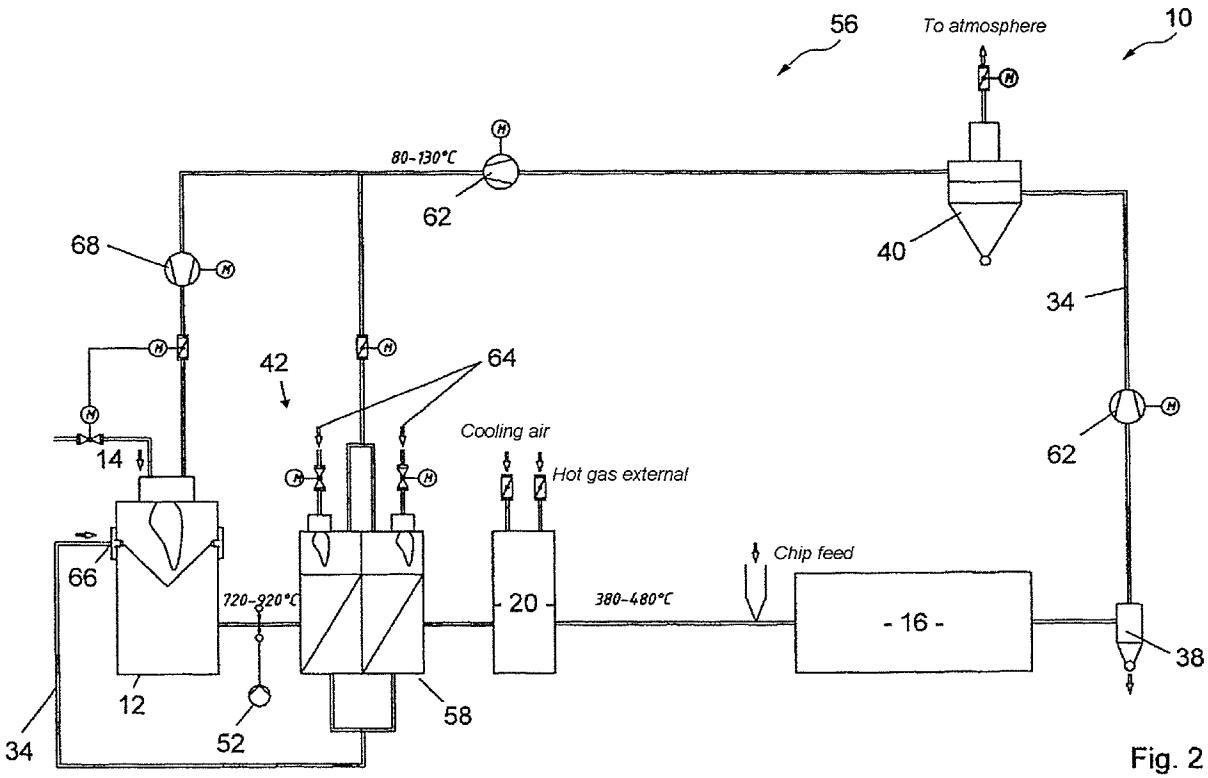
FIG. 2 shows a circuit diagram of a second embodiment of a wood chip drying system according to the invention.

FIG. 2 shows a second embodiment of a wood chip drying system 10 according to the invention with a furnace 12, with the drier 16 for the wood chip 18 and with the recirculation device 56 for recirculating the vapors 34 into the drier 16. The recirculation device 56 comprises the vapor heater 42 which comprises a regenerative, recuperative and/or catalytic heat exchanger 58 which is arranged downstream of the drier and is designed for heating the vapor 34 to a temperature which is so high that particles present in the vapor 34 are at least for the predominant part oxidized.

The vapor 34 flows from the heat exchanger 58 to the furnace 12 and is mixed there with wood dust 14, natural gas and/or light oil, and the mixture is burnt. The flue gases occurring are routed once again via the heat exchanger 58 and then enter the mixing chamber 20 where, if appropriate, they are mixed with hot gas or cooling air, so that drier gas is obtained. The drier gas is supplied to the drier 16.

The vapors are conducted via a suction draft fan 62 into the cyclone 40 which is combined with an electrostatic wet filter and which forms a vapor purification system. By means of a further suction draft fan, the back vapors are supplied to the regenerative heat exchanger system 58 which can be heated by means of a firing unit 64 for a natural gas, light oil or heavy oil for the purpose of carrying out burnout. The vapors leave the regenerative heat exchanger system 58 and arrive at a vapor injection 66. Part of the vapors is conducted into the combustion chamber or the furnace 12 via a combustion air blower 68.

In the embodiment according to FIG. 2, the heat exchanger system 58 is designed such that the back vapors pass through it, essentially unchanged. The heat exchanger system 58 serves for saving energy and for increasing efficiency. It can, if necessary, be burnt out by means of the firing unit 64. The regenerative heat exchanger system 58 is superior to a tube bundle heat exchanger in terms of thermal efficiency and availability. The thermal treatment of the back vapors takes place in the furnace 12, that is to say the combustion chamber.

Figure 3:
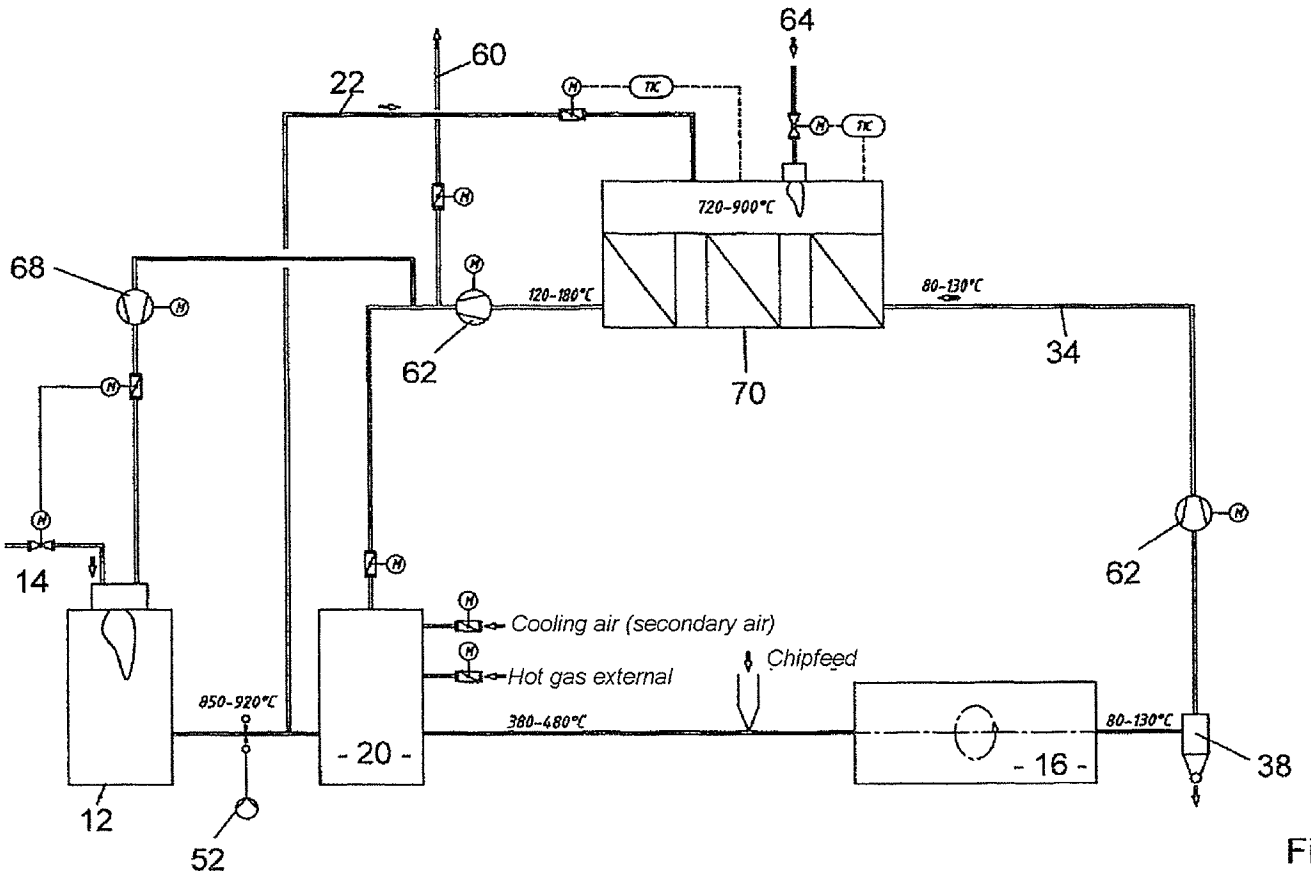
FIG. 3 shows a circuit diagram of a third embodiment of a wood chip drying system according to the invention.

FIG. 3 shows a circuit diagram of a wood chip drying system according to the invention in which the vapors 34 are conducted into a thermally regenerative overall vapor purification system 70. The overall vapor purification system 70 is operated with flue gas 22 and can be fired with alternative fuels, natural gas, light oil or heavy oil via the firing unit 64.

The invention claimed is:

1. A method for drying wood chip, comprising:

(a) conduction of flue gas from a furnace to a drier, (b) drying of the wood chip in the drier, so that vapor is obtained, and (c) recirculation of at least part of the vapor into the drier, wherein:

(d) thermal reduction, in particular by oxidation, of solids present in the vapor prior to recirculation into the drier in at least one of regenerative heat exchanger.

2. The method as claimed in claim 1, wherein for thermal oxidation of organic compounds and solids present in the vapor, at least part of the vapor is recirculated into the furnace.

3. The method as claimed in claim 1, wherein a fraction of flue gas from the furnace in the drier gas flowing into the drier is higher than a predetermined flue gas fraction threshold value.

4. A method for producing a wood material board, comprising:

production of wood chip by means of a method as claimed in claim 1, a predetermined residual moisture content in the wood chip being set, mixing of the wood chip with adhesive, and pressing of the wood chip together with the adhesive into the wood material board.

5. A wood material board, produced by a method as claimed in claim 2.

6. The method as claimed in claim 4, wherein the wood material board is oriented strand board (OSB).

7. A wood material board, produced by a method as claimed in claim 4.

8. A wood chip drying system for drying wood chip, comprising (a) a furnace, (b) a drier for the wood chip, (c) a recirculation device for recirculating vapors into the drier, (d) the recirculation device having a vapor heater, and (e) the wood chip drying system being designed for reduction of organic compounds present in the vapor prior to recirculation into the drier, wherein:

(f) the vapor heater comprises a regenerative heat exchanger which (i) is arranged downstream of the drier, and (ii) is designed for heating the vapor to a temperature which is so high that solid particles present in the vapor are at least for the predominant part oxidized.

9. The wood chip drying system as claimed in claim 8, wherein the recirculation device is designed for recirculating at least part of the vapors into the furnace, wherein the recirculation device is designed for recirculating part of the vapors coming from the heat exchanger into the furnace.

10. The wood chip drying system as claimed in claim 9, wherein the recirculation device is designed for heating the vapors by means of flue gas from the furnace.

11. The wood chip drying system as claimed in claim 9, wherein the vapor heater is designed for heating the vapors to a temperature above 700° C. by means of internal combustion.

12. The wood chip drying system as claimed in claim 9, further comprising a nitrogen oxide reduction system which is arranged downstream of the furnace.

13. The wood chip drying system as claimed in claim 11, further comprising a mixing chamber which is arranged for mixing:

flue gas from the furnace, and vapor from the vapor heater.

14. The method as claimed in claim 8, further comprising burnout of solids sticking in the regenerative heat exchanger.

15. The method as claimed in claim 8, wherein back vapor volume flow, before entry into a mixing chamber, is conducted into a thermally regenerative heat exchanger, the back vapors having an entry temperature of 80° C. to 130° C. being heated to a temperature of 720° C. to 900° C. and being routed to the mixing chamber at an exit temperature approximately 20° C. to 80° C. higher than the entry temperature.

16. The wood chip drying system as claimed in claim 9, further comprising:

a nitrogen oxide reduction system which is arranged downstream of the furnace, a mixing chamber which is arranged for mixing, flue gas from the furnace, and vapor from the vapor heater.

* * * * *